United States Patent [19]

Jarrabet

[11] Patent Number: 4,997,704

[45] Date of Patent: Mar. 5, 1991

[54] PLASMA-ARC CERAMIC COATING OF NON-CONDUCTIVE SURFACES

[75] Inventor: Gregory P. Jarrabet, Glenwood, Fla.

[73] Assignee: Technetics Corporation, DeLand, Fla.

[21] Appl. No.: 360,860

[22] Filed: Jun. 2, 1989

[51] Int. Cl.[5] ..... B05D 1/10

[52] U.S. Cl. ..... 428/292; 427/34; 427/404; 428/472; 428/323

[58] Field of Search ..... 427/423, 34, 404; 428/292, 472, 323

[56] References Cited

U.S. PATENT DOCUMENTS

| | | | |
|---|---|---|---|
| 3,179,531 | 4/1965 | Koubek | 427/423 |
| 4,578,310 | 3/1986 | Hatfield | 427/423 |
| 4,883,703 | 11/1989 | Riccio | 427/423 |

FOREIGN PATENT DOCUMENTS

| | | | |
|---|---|---|---|
| 66782 | 12/1982 | European Pat. Off. | 427/423 |
| 2046627 | 3/1972 | Fed. Rep. of Germany | 427/423 |

*Primary Examiner*—Shrive Beck

[57] ABSTRACT

For high temperature applications, ceramic coatings are plasma-sprayed onto various substrates. Plasma-spraying of ceramics onto non-conductive polymer surfaces often results in coatings which are poorly adherent. Adherent, non-spalling, ceramic layers can be achieved by first coating the non-conductive surface with an adhesively bonded, more conductive layer. It is postulated that the resulting more conductive coating is sufficient to prevent the build-up of electrostatic charges which can act to repel the plasma-sprayed particles. After the more conductive layer is applied (a bond coat may be employed, but is generally unnecessary), the ceramic powders are plasma-sprayed.

9 Claims, No Drawings

PLASMA-ARC CERAMIC COATING OF NON-CONDUCTIVE SURFACES

TECHNICAL FIELD

This invention relates to the ceramic coating of substantially non-conductive polymers, particularly high temperature polymer composites reinforced with fibers such as fiber glass, graphite, KEVLAR, etc.

BACKGROUND

Because of the well-known advantages of reinforced composites (i.e., high strength to weight ratio, controlled thermal expansion), it would be desirable to use such composites in high temperature applications, for example, in parts of turbine engines. However, since the matrix polymers employed in such composites normally degrade at temperatures within the range of 250° to 400° C., they have not enjoyed wide application. One solution for extending the applicable temperature range of such composites, analogous to the solution employed for metal structures, would be the use of ceramic coatings—to provide oxidation protection and to act as an insulative thermal barrier. Unlike metal surfaces, it is often difficult to form acceptable ceramic coatings on composite surfaces, i.e., coatings with good adherence and which do not spall in service. A potential solution, described in U.S. Pat. No. 3,179,531, is the incorporation of refractory materials intermixed into the top layer of the composite, i.e., the surface to be coated, such that refractory material is firmly embedded in that surface and acts to form a bond with the refractory material which is subsequently sprayed thereon to the desired thicknesses. Another solution is shown in U.S. Pat. No. 3,892,883, wherein adherence is improved by utilizing two intermediate layers—the first layer being copper/-glass, which is adherent to the composite surface; and the second layer being a nickel aluminide, which bonds well both to the copper/glass layer and to the subsequent plasma-sprayed refractory layer. Yet another solution is shown in U.S. Pat. No. 4,388,373 wherein an adherent intermediate layer is flame sprayed onto the plastic surface—using a powder composition consisting of a mineral powder admixed with small amounts of nylon and expoxy powders. None of these processes has gained wide acceptance in the industry—either because ceramic coatings so-produced are nevertheless suboptimal and/or because the method involved is unduly cumbersome and costly.

DISCLOSURE OF THE INVENTION

It has now been found that the poor adherence resulting from the plasma-arc spraying of ceramic powders onto a cleaned composite surface is, to a significant extent, due to the inability of such surface to dissipate electrostatic charge. Thus, adherent ceramic coatings can be achieved by enhancing the conductivity of the polymer surface to an extent somewhat analogous to that required to achieve substantial attenuation of electromagnetic signals (EMI shielding). However, known methods for achieving signal attenuation (e.g., vacuum metallizing, sputtering, flame- and arc-spraying), in addition to being cumbersome and costly, will often result in an intermediate, conductive layer which is poorly adherent to the composite surface. The instant invention employs a comparatively simple procedure in which an adhesive coating is bonded to the surface, such adhesive having incorporated therein a sufficient amount of conductive material(s) to reduce the resistivity by at least two orders of magnitude. For effective adherence of the sprayed ceramic powders, the resistivity of the adhesively bonded intermediate layer should always be less than $10^3$ ohm/cm. Desirably, the intermediate layer applied to the polymer surface will be somewhat conductive, i.e., incorporating sufficient metal or metalloid material to achieve a resistivity below $10^2$ ohm/cm, and preferably below 1 ohm/cm. The resulting surface, when measured in terms of EMI shielding effect, should exhibit a signal attenuation of at least 30 db, and desirably at least 50 db.

MODES FOR CARRYING OUT THE INVENTION

As noted above, the present invention is based on the finding that the problems associated with the plasma-arc spraying of ceramic powders onto composite surfaces are, to a significant extent, the result of the high electrical resistivity of such surfaces (when such surfaces are composed of non-conductive or poorly conductive materials). Although texts may differ as to the exact demarcation line between non-conductive, semi-conductive, and conductive materials, it is generally understood that the resistivity of non-conductive materials ranges from about $10^8$ to $10^{16}$ ohm/cm. Examples of non-conductive materials (together with their nominal resistivities) are: polystyrene ($10^{16}$ ohm/cm); epoxy ($10^{14}$ ohm/cm); and polyurethane ($10^9$ ohm/cm). When graphite reinforcement fibers or graphite powders (fillers) are employed in such polymers, conductivity is substantially enhanced. For example, graphite fillers are employed in "anti-static" rubber to provide resistivities normally within the range of $10^6$ to $10^2$ ohm/cm. The instant invention is useful in enhancing the adherence of plasma-arc sprayed ceramic deposits on all such materials. Substantial enhancement for non-conductive materials will be realized by employing an adhesively bonded intermediate layer, in which the electrical resistivity of the surface is reduced to below $10^3$ ohm/cm. If the original material already exhibits a volume resistivity of $10^2$ or $10^3$ ohm/cm, substantial enhancement will be realized by employing a conductive coating which decreases the surface resistivity at least two orders of magnitude. For example, if the composite to be coated exhibits a resistivity of $10^2$ ohm/cm, the intermediate coating should have a resistivity below 1 ohm/cm.

As noted, the adherence of plasma sprayed ceramics can be enhanced by surface treatments similar to those employed to enhance signal attenuation. Such surface treatments include, for example: (i) vacuum metallizing—the deposition of a metallic film by evaporation in a high vacuum. Although attenuation is good, the capital and operating costs involved in the use of this method are extremely high; (ii) sputtering—which is also performed in a high vacuum, wherein excited argon atoms are employed to sputter metal atoms onto the target surface; (iii) flame--and arc-spraying—in which metal wires or powders are fed into and melted in a high temperature flame or arc, whereby the resultant molten metal particles are ejected by an atomizing gas onto the target; and (iv) the use of metal paints—in which conductive polymer coatings are applied to the surface. In addition to the high capital and operating costs associated with some of these treatments, it is often difficult to achieve a strongly adherent metal layer using such procedures—particularly a layer capable of withstanding the oxidative and temperature conditions existing in a jet engine. A coating capable of withstanding such conditions can be achieved, economically, by the incorporation of conductive, filler materials (e.g., metals or metalloids) in adherent adhesives, for example, adhesives such as polyimides. The adhesive will preferably have a continuous use temperature (i.e., temperatures at which it is thermally stable and retains a substantial amount of its mechanical properties) above 250° C., and more preferably in excess of 350° C. The conductive materials, whether they be metal, metalloid, or a combination of both, may be incorporated into the coating in a variety of ways, i.e., as: (i) dispersions of fibrils or particles admixed in a liquid adhesive, prior to its application on the surface; (ii) fibrils or powders sifted onto a liquid adhesive, after it has been applied to the surface; or (iii) fibers, strands, screens, etc. compressed into the adhesive.

The instant process should be distinguished from the prior art procedure, as exemplified by U.S. Pat. No. 4,338,380, in which a web of metal fibrils is brazed or otherwise adhered to a metal base to serve as a compliant, intermediate layer between the metal base and the plasma-sprayed ceramic layer, to compensate for the differences in thermal expansion of the metal base and the ceramic layer. In the instant process, when particulate metals are adhered to the surface, they are employed to provide adherence of the plasma-sprayed ceramic onto a non-conductive or poorly conductive base material; whereas, adherence is generally good when spraying ceramics onto metal bases. Additionally, to meet the objectives of the instant invention, the metal (or metalloid) fibril layer may be comparatively thin in relation to the compliant layer of the prior art and the fibril layer need not be compliant. The thickness of the fibril layer will, of course, be dependent on the size (e.g., wire diameters) of the conductive fibrils. A web of metal fibers employed to provide compliancy will be comparatively thicker, because of the number of fibrils stacked on top of each other. A compliant web will normally require a stack at least six fibrils high (overlapped at different angles with respect to each other) to provide requisite compliancy, whereas fibrils incorporated into or onto an adhesive for purposes of this invention, may be randomly dispersed and stacked to provide a surface layer less than six fibrils in height.

I claim:

1. In the plasma-spray coating of ceramic powders onto a surface of a substantially non-conductive resin material, the method for enhancing the adherence of the ceramic particles striking said surface, which comprises:

prior to spraying the ceramic powders, adhesively bonding an intermediate coating onto the surface to be ceramic coated, said adhesive having a continuous use temperature greater than 250° C. and incorporating a sufficient combination of conductive materials such that the outer layer of said intermediate coating has a resistivity below $10^3$ ohm/cm.

2. The method of claim 1, in which the adhesive employed has a working temperature greater than 350° C. and is loaded with sufficient conductive materials to provide an outer layer with a resistivity less than $10^2$ ohm/cm.

3. The method of claim 1, in which said conductive materials are in the form of finely divided particles or fibrils, which are uniformly dispersed in the adhesive prior to applying the adhesive to said non-conductive surface.

4. The method of claim 1, in which the adhesive, in liquid form, is applied to said non-conductive surface; and the conductive materials, in the form of particulate fibrils or particles, are sifted onto the liquid adhesive, prior to the setting or hardening thereof.

5. The method of claim 1, wherein adhesive is applied to the non-conductive surface and said conductive materials are thereafter embedded into the adhesive, prior to the setting or hardening thereof.

6. The method of claim 5, wherein said conductive materials are in the form of metal fibrils, sintered webs, or screens.

7. The method of claim 1, wherein the outer layer of said adhesive coated surface is loaded to provide a resistivity at least two orders of magnitude lower than that of said non-conductive surface.

8. A polymer structure having a ceramic coating on at least one surface thereof, said coating having been plasma-arc sprayed onto said surface utilizing the method of claim 1.

9. A polymer structure having a ceramic coating on at least one surface thereof, said coating having been plasma-arc sprayed onto said surface utilizing the method of claim 5.

* * * * *